US006354315B1

(12) United States Patent
Liu

(10) Patent No.: US 6,354,315 B1
(45) Date of Patent: Mar. 12, 2002

(54) UMBRELLA STRUCTURE

(76) Inventor: Futien Liu, No. 6, Lane 174, Chung Chen Rd., Lu Chou Shiang, Taipei Hsien (TW)

( * ) Notice: Subject to any disclaimer, the term of this patent is extended or adjusted under 35 U.S.C. 154(b) by 0 days.

(21) Appl. No.: 09/527,261

(22) Filed: Mar. 17, 2000

(51) Int. Cl.[7] ..... E04H 15/28

(52) U.S. Cl. ..... 135/98; 135/28; 135/29; 135/31

(58) Field of Search ..... 135/25.1, 25.2, 135/25.3, 28–32

(56) References Cited

U.S. PATENT DOCUMENTS 2,334,330 A * 11/1943 Janowsky ..... 135/25.2
3,853,136 A * 12/1974 Schwartzenberg ..... 135/25.2
4,193,415 A * 3/1980 Hermanson ..... 135/25.2
4,601,301 A * 7/1986 Hermanson ..... 135/25.2
4,942,693 A * 7/1990 Sibold ..... 135/25.2
5,758,677 A * 6/1998 Wang ..... 135/24
5,836,328 A * 11/1998 Lee ..... 135/25.2
5,865,201 A * 2/1999 Lin ..... 135/25.2
6,070,602 A * 6/2000 Kuo ..... 135/25.4
6,230,727 B1 * 5/2001 Chen ..... 135/98

* cited by examiner

*Primary Examiner*—Beth A. Stephan
(74) *Attorney, Agent, or Firm*—Rosenberg, Klein & Lee

(57) ABSTRACT

A novel umbrella structure, comprises mainly a shaft, two surface frames, and two connecting parts; wherein, the connecting parts are formed basically by crossing two ribs with each other, and linking them with an main notch and a main runner provided on the shaft and with an sub-notch and sub-runner provided on the surface frames, such that each surface frame can be linked on both symmetrical sides of the shaft, respectively, by the connecting part. As the main runner provided as a sleeve around the shaft slides up and down, the sub-runner on the surface frame will be driven by the connecting parts and slide up and down correspondingly, and its distance to the sub-notch is exactly equal to the distance from the main runner to the main notch and thereby, the umbrella surface can be completely spread out.

10 Claims, 8 Drawing Sheets

UMBRELLA STRUCTURE

BACKGROUND OF THE INVENTION

1. Field of The Invention

The invention relates to a novel umbrella structure, and in particular, to a novel umbrella structure in which the symmetrical sides with respect to the shaft of the umbrella are connected with surface frames by means of connecting parts so as to increase the opening area of the surface fabric.

2. Description of the Prior Art

Conventional multiple-folding umbrella normally aim at an end of lightweight, thinness and miniature for the convenient carrying by the users. However, those conventional types of multiple-folding umbrella have a relatively limited surface area when they are opened. Consequently, use of multiple-folding umbrella in the rainy day often causes wetting of the user by the rain.

Accordingly, in order to solve the drawback of the limited surface area of the above-mentioned multiple-folding umbrella, folding umbrella with increased overall surface area has been developed, as shown in FIGS. 1 and 2. The umbrella 10 comprises mainly fixing two cross-connecting stretchers 15 and 16 on the shaft 13 by using the shaft 13 as the cross point 14; attaching notches 11*a,* 11*b* and runners 12*a,* 12*b* on both ends of stretchers 15 and 16, respectively, in a manner that said notches 11*a*, 11*b* and runner 12*a*, 12*b* are positioned symmetrically on both sides of the shaft 13; connecting inner main ribs 18*a*, 18*b* and inner branched rib 17*a,* 17*b* of the two-folding rib at a position between said notches 11*a,* 11*b* and said runners 12*a,* 12*b* such that the object of increasing surface area can be achieved. However, since the lengths of said inner main ribs 18*a,* 18*b* and said inner branched ribs 17*a,* 17*b* must be equal to the distance from runners 12*a,* 12*b* or notches 11*a*, 11*b* to the cross point 14 of the two stretchers 15, 16 such that the umbrella 10 can be opened or closed, when it applies to the two-folding type of ribs, a maximum surface area can be obtained, but in case of umbrella with three- or more folding type of ribs, lengths of main ribs 18*a,* 18*b* and branched ribs 17*a,* 17*b* are invariably less than those in case of two-folding type, leading to the correspondingly shortening of lengths of stretchers 15, 16 and hence the dramatically decreasing of surface area. Thus, though that structure of umbrella 10 can increase the surface area, it cannot apply to other multiple folding types of ribs. Furthermore, during opening or closing of said umbrella 10, moving of stretchers 15, 16 can be done only through driving by assisting stretchers 19*a,* 19*b,* 19*c,* and 19*d,* resulting in not only a complicated structure but also time-consuming and cost increasing that can not meet the economical efficacy.

Therefore, the above-mentioned conventional umbrella has still many drawbacks and is not a well designed one that further improvement is needed.

In view of the various disadvantages associated with the conventional multiple folding type of umbrella, the inventor has aimed at improving and creating, and, after extensive and comprehensive studies, developed successfully an umbrella with novel structure and thus accomplished the invention.

SUMMARY OF THE INVENTION

One object of the invention is to provide a novel umbrella structure in which upper and sub-runners are provided on symmetrical sides with respect to the shaft of the umbrella, and surface frames are connected on both symmetrical sides of the shaft by means of connecting parts formed by cross-engaging two ribs so as to increase the opening area of the surface fabric.

Another object of the invention is to provide a novel umbrella structure wherein connecting parts are provided and connected on both sides symmetrical with respect to the shaft such that it can retain a larger surface area as it applies to two-, three- or four-folding type of the shaft.

Still another object of the invention is to provide a novel umbrella structure wherein, unlike conventional umbrella that stretchers can only be driven by means of assisting stretchers, connecting parts formed by cross-engaging two ribs are linked directly to upper and main runners such that said connecting parts can move as the main runners runs up and down, and functions of a simple structure, easy fabricating and cost lowering can be achieved.

With advantages described above, the novel umbrella structure according to the invention comprises a shaft, two surface frames, upper and main runners, and two connecting parts; wherein said main notch is fixed at the top of said shaft while said main runner is provided as a sleeve around said shaft and can slide up and down along said shaft; wherein said surface frames are consisting of upper and sub-runners linked by main ribs and branched ribs; wherein an umbrella surface is provided covering said main ribs such that it can be opened and closed by virtue of the relative moving of said upper and sub-runners; wherein said connecting parts is formed mainly by cross-engaging of two ribs in a manner that both ends of the first rib are connected to a main notch and a sub-runner, while both ends of the second rib are connected to a main runner and a sub-notch such that the two surface frames can be linked symmetrically at both sides by means of said two connecting parts, and as said main runner slides up and down over said shaft, the distance it slide over can be transferred via said connecting parts, resulting change of positions of said two sub-runners, so as to achieve the function of increasing surface area of the umbrella.

BRIEF DESCRIPTION OF THE DRAWINGS

The drawings disclose an illustrative embodiment of the present invention which serves to exemplify the various advantages and objects hereof, and are as follows.

Symbols referred to main parts:

| | | | |
|---|---|---|---|
| 10 | umbrella | 11b | notch |
| 11a | notch | 12b | runner |
| 12a | runner | 13 | shaft |
| 14 | cross point | 15 | stretcher |
| 16 | stretcher | 17b | inner branched rib |
| 17a | inner branched rib | 18b | inner main rib |
| 18a | inner main rib | 2 | shaft |
| 31 | main runner | 32 | main notch |
| 33 | main runner | 35 | compressive spring |
| 36b | stretcher | 36a | stretcher |
| 37 | handle | 38 | bottom spring |
| 4 | connecting part | 41 | the second rib |
| 411 | port | 42 | the first rib |
| 5 | connecting part | 6 | surface frame |
| 61 | sub-notch | 62 | sub-runner |
| 63 | branched rib | 64 | main rib |
| 7 | surface frame | 71 | sub-notch |
| 72 | sub-runner | 73 | branched rib |
| 74 | main rib | 8 | pivotal pin |
| 9 | connecting part | 91 | the third piece |
| 92 | the fourth piece | 93 | the first piece |
| 94 | the second piece | 95 | the cylinder |
| 96 | pivotal pin | 97 | sub-notch |
| 98 | sub-runner | 99 | space |
| 21 | shaft | 22 | rib |
| 23 | rib | | |

DETAILED DESCRIPTION OF THE PREFERRED EMBODIMENT

Figure 1:
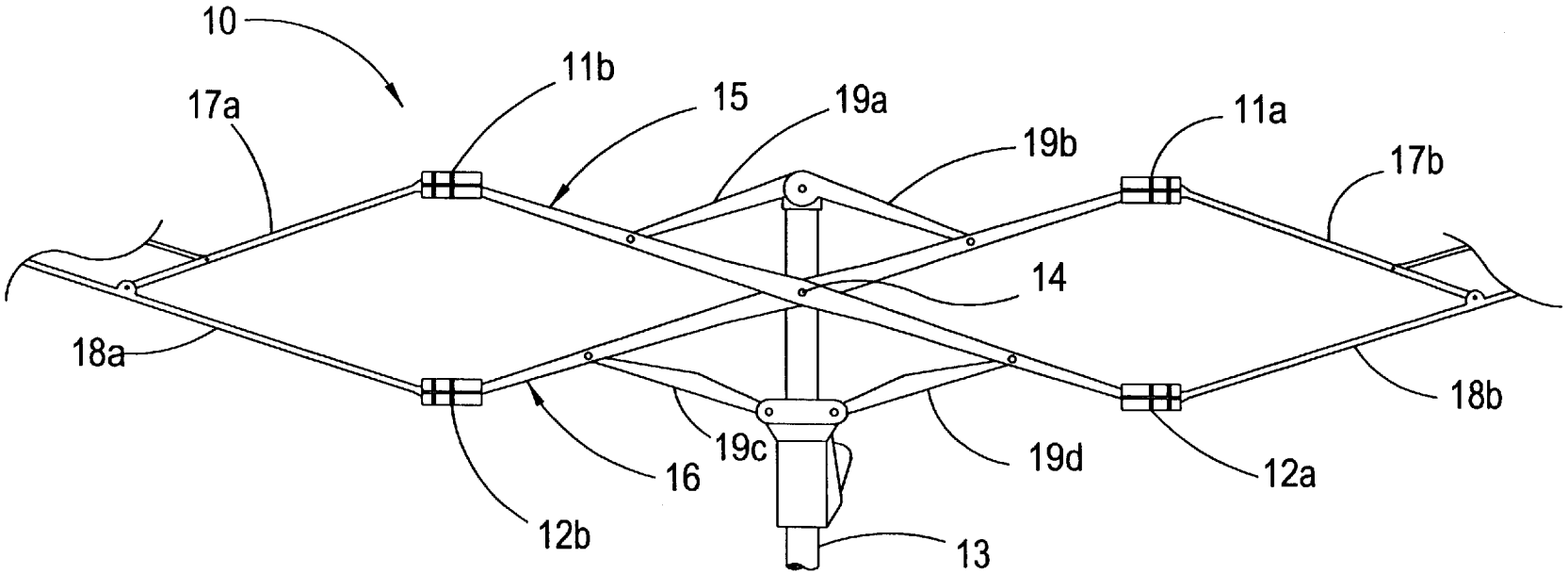
FIG. 1 PRIOR ART
FIG. 1 is a schematic view of a conventional multiple-folding umbrella in an opening state.
Figure 2:
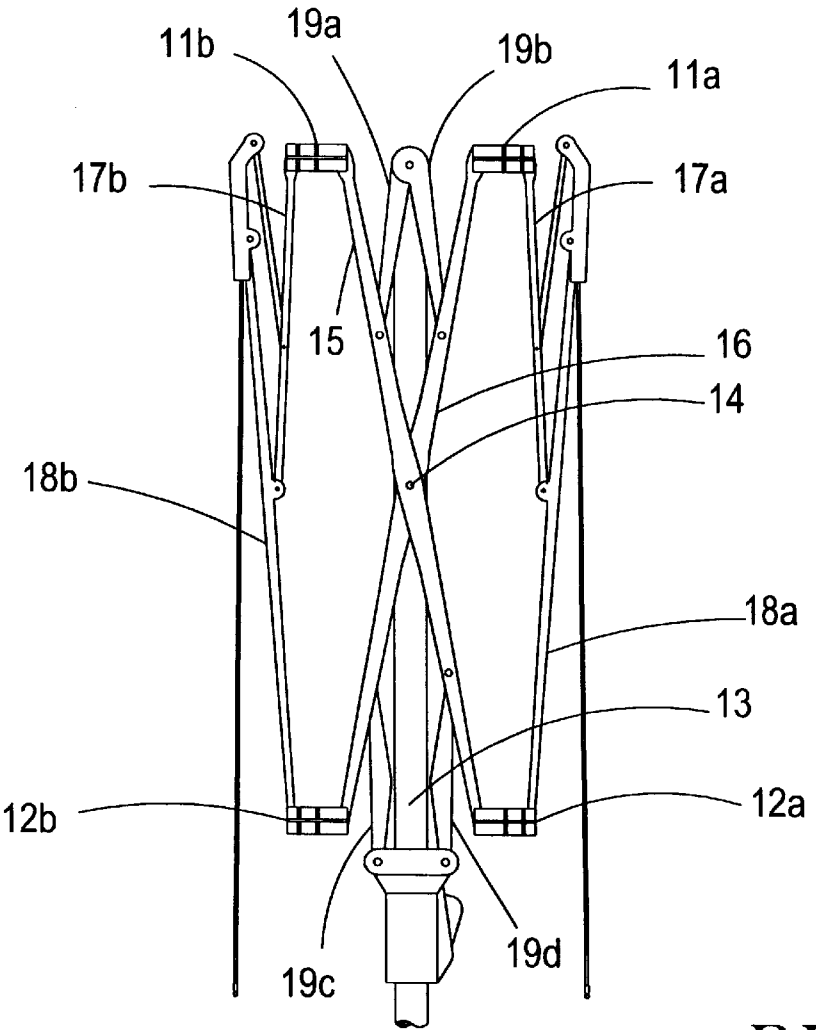
FIG. 2 PRIOR ART
FIG. 2 is a schematic view of a conventional multiple-folding umbrella in a closed state.
Figure 3:
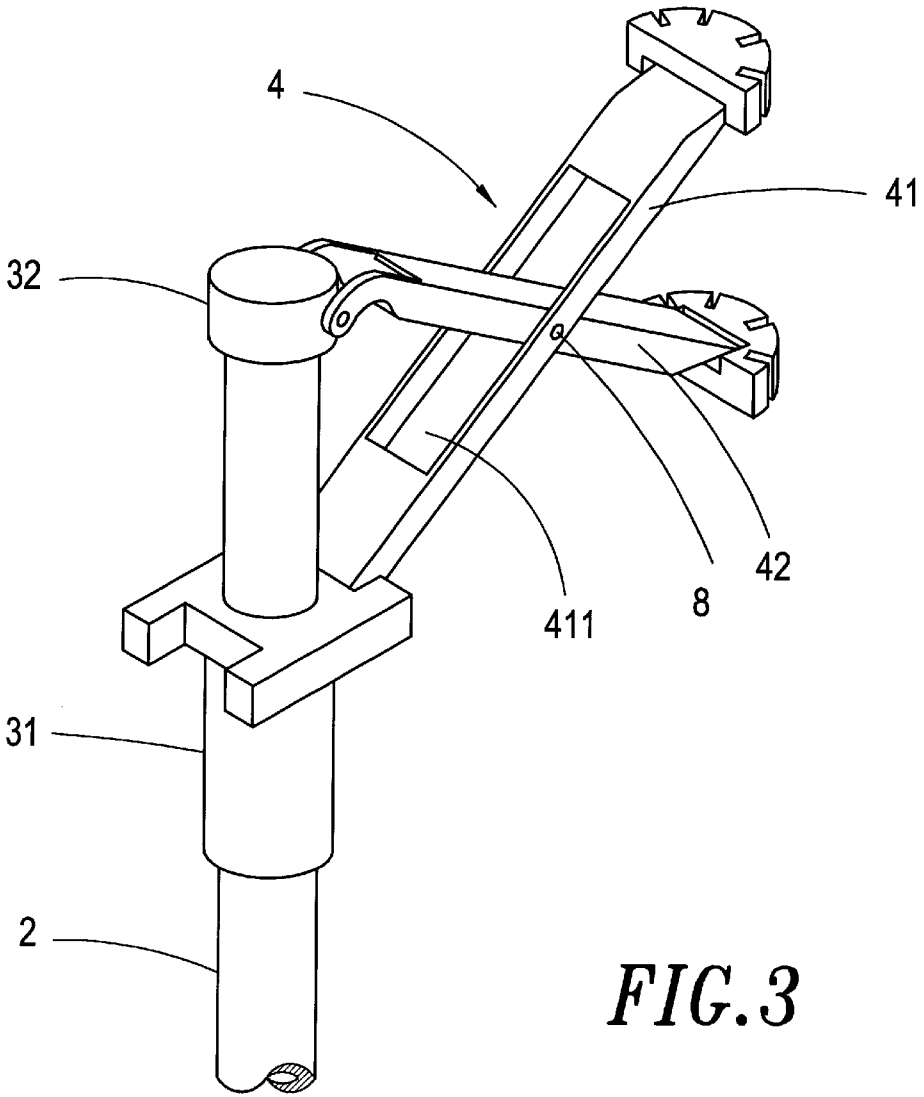
FIG. 3 is a schematic view showing the association of connecting parts in the umbrella with a novel structure according to the invention.

Referring to FIG. 3, a schematic view showing the association of connecting parts in the umbrella with a novel structure according to the invention, connecting part 4 is constructed by a first rib 42 and a second rib 41 of equal length, wherein a port 411 is provided on the second rib 41 such that the first rib 42 can pass through the second rib 41 via said port 411 and thus forms a cross pivotal point with said second rib 41. Further, a pivotal pin 8 is provided to penetrate said cross-pivotal point so as to cross-connect both ribs 41 and 42 and form a connecting part. Alternatively, the port can be provided on the first rib 42 for being penetrated by the second rib 41 and achieving the same purpose of cross connecting.

Figure 4:
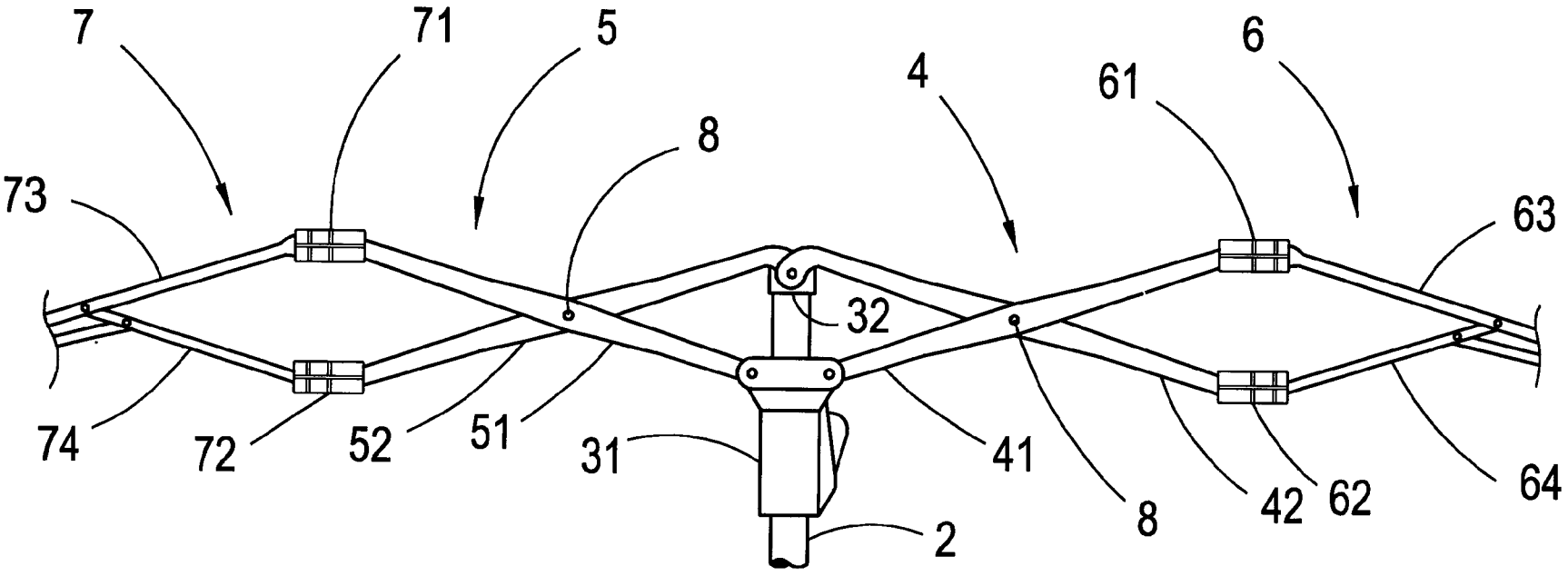
FIG. 4 is a schematic view of the umbrella with a novel structure according to the invention in an opening state.
Figure 5:
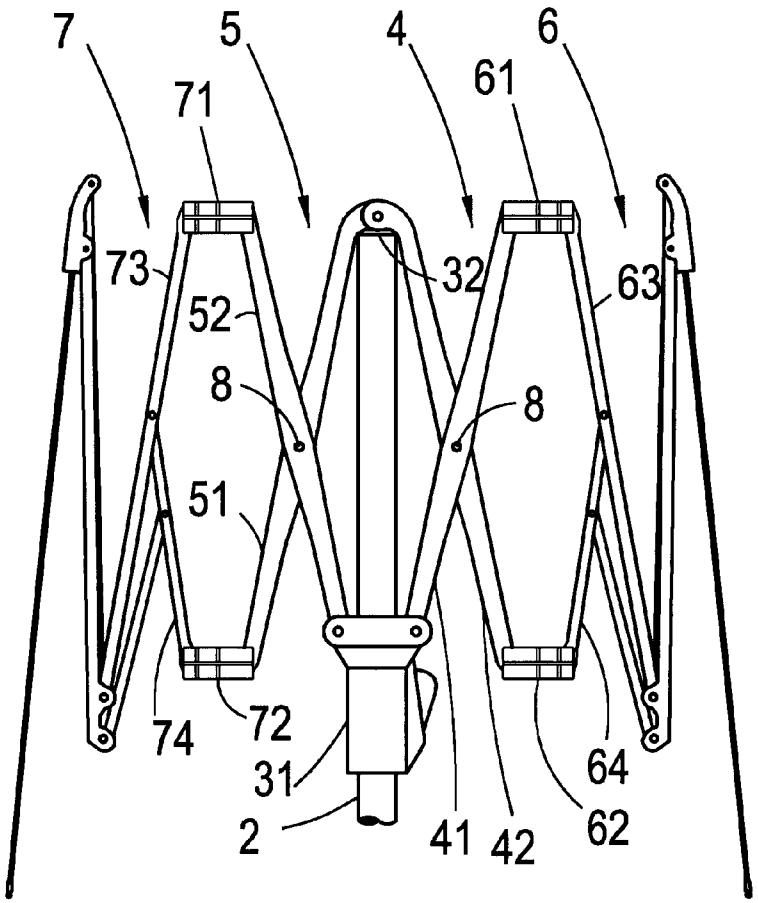
FIG. 5 is a schematic view of the umbrella with a novel structure according to the invention in a closed state.

Referring to FIGS. 4 and 5, showing the novel umbrella structure according to the invention, comprises mainly a shaft 2, an main notch 32, a main runner 31, two surface frames 6 and 7, and two connecting parts 4 and 5; wherein, said main notch 32 is fixed on the top of said shaft 2, while the main runner 31 is provided as a sleeve around said shaft 2 so as to slide up and down over said shaft 2; wherein said surface frames 6, 7 comprise sub-notches 61, 71 and sub-runner 62,72, and between said sub-notches 61, 71 and sub-runner 62,72, branched ribs 63, 73 and main ribs 64, 74 are provided to form as a folding rib that connects said sub-notches 61, 71 and sub-runner 62,72; and wherein a surface fabric is provided over said folding rib in a manner that said surface fabric can be opened or closed through the relative motion of said sub-notches 61, 71 and sub-runner 62,72. The mechanism comprises principally linking said connecting part 5 and 6 on both sides of the shaft 2, where the first rib 42, 52 on said connecting parts 5, 6 are connected on their both ends, respectively, with said main notch 32 on the top of the shaft 2 and with the sub-runner 62, 72 on said surface frames 6, 7, while said second rib 41, 51 are connected on their both ends, respectively, with said main runner 31 and said sub-notch 61, 71, such that said surface frames 6, 7 can be linked on both symmetrical sides of said shaft 2 by means of said connecting parts 4, 5. Thus, as the main runner 31 slides up and down, said connecting parts 4, 5 will move correspondingly with the sliding of said main runner that, in turn, will drive said sub-runner 62, 72 on said surface frames 6, 7 to slide up and down, and where the distance from said sub-runner 62, 72 to said sub-notch 61, 71 is just equal to the distance from said main runner 31 to said main notch 32, and thereby, opening and closing of the surface fabric can be accomplished and the function of increasing surface area and reducing the length of the umbrella upon closing can be achieved.

Figures 6A, 6B:
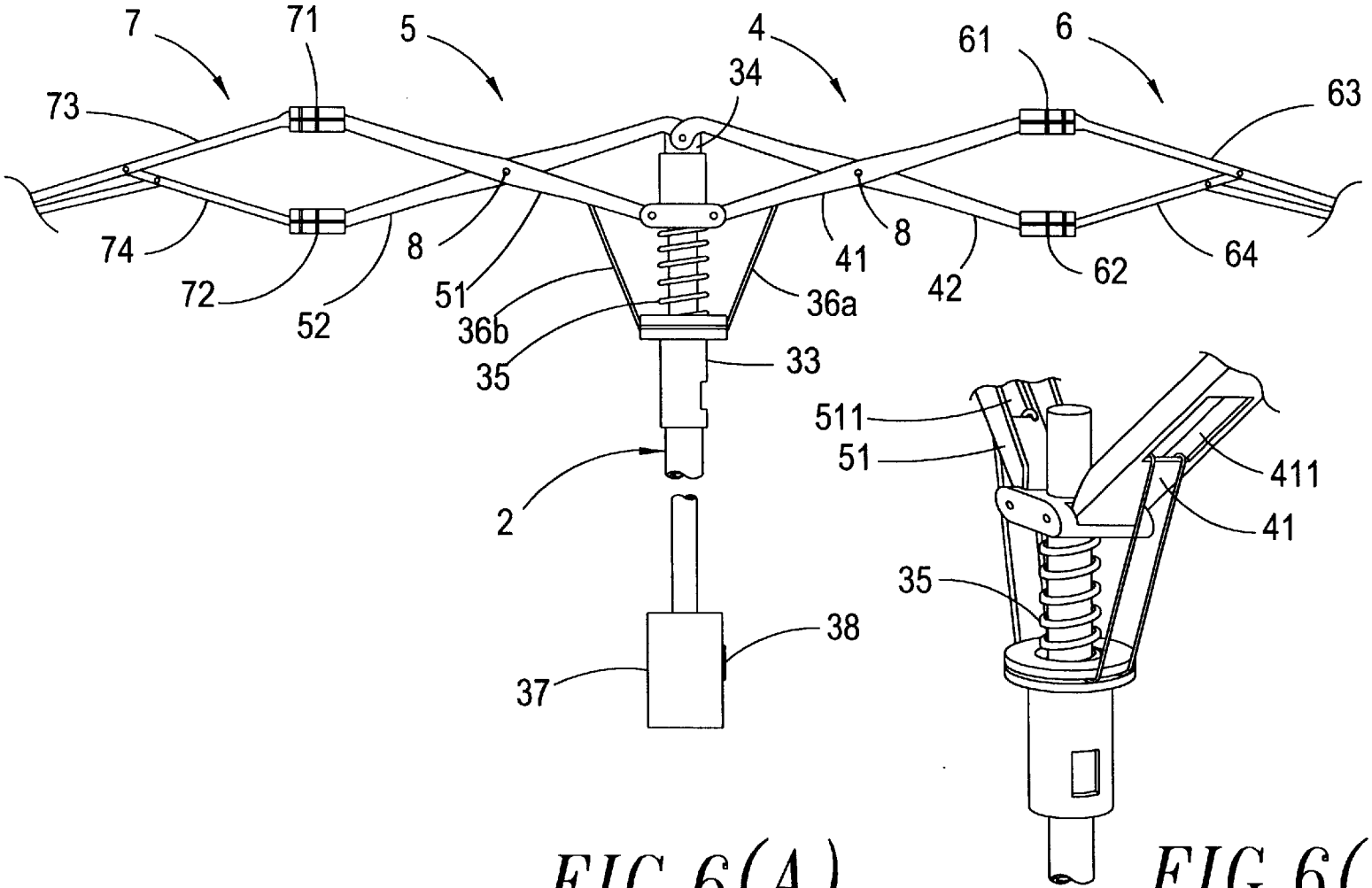
FIGS. 6A and B are schematic views showing the use of the umbrella a novel structure according to the invention to a self-opening folding umbrella.

Referring to FIGS. 6A and B, showing an embodiment of the novel umbrella structure according to the invention, it can be made into a self-opening folding umbrella simply just by providing a compressive spring 35 on the main runner 33. Thus, as the umbrella is closed, said spring 35 is in a compressed state while the bottom spring 38 on the handle 37 is pushed down, the compressive spring 35 will be released and thereby drive said main runner 33 to slide upwardly that, in turn, opens the surface fabric. On the other hand, when the umbrella is closed, since both sides of said main runner 31 are linked to stretchers 36*a* and 36*b*, respectively, and the other ends of said stretchers 36*a* and 36*b* are linked in ports 411 and 511 provided on the second rib 41 and 51 respectively, as the main runner 33 moves downwardly, connecting parts 4, 5 will be pulled in place by virtue of said two stretchers 36*a* and 36*b* and thereby closes the surface fabric of the umbrella.

Figure 7:
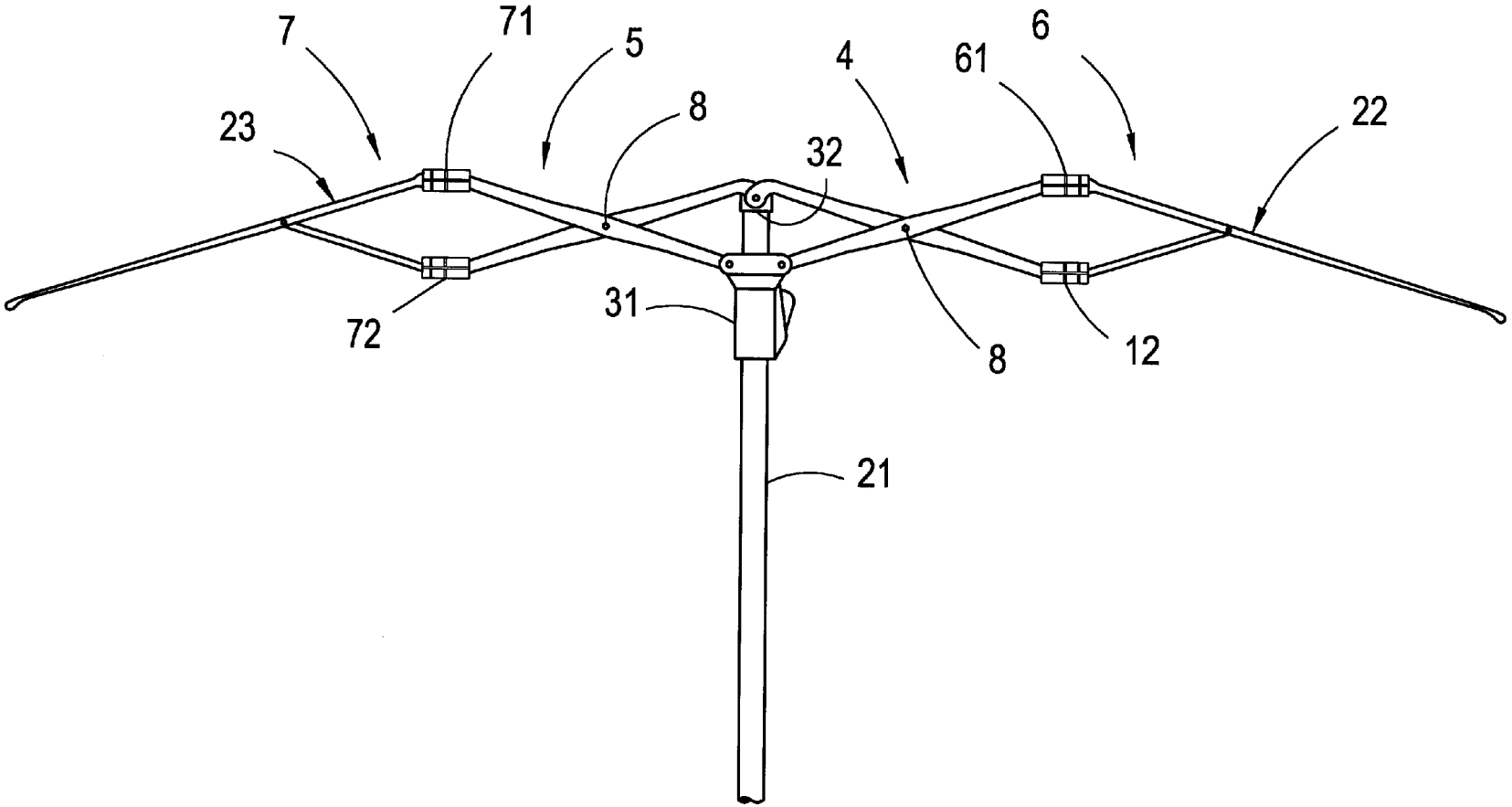
FIG. 7 shows another embodiment of the umbrella with a novel structure according to the invention.

Referring to FIG. 7, showing another embodiment of the novel umbrella structure according to the invention, it can apply to the umbrella having a straight shaft, wherein, similarly, connecting parts 4,5 are linked with the shaft 21 and surface frames 6, 7, and ribs 22, 23 are provided between sub-notches 61, 71 and sub-runner 62, 72 on the surface frames 6 and 7 and are as the connection therebetween, such that, as the main runner 31 slides up and down, the surface fabric will be opened by surface frames 6, 7 driven through the pushing of said connecting parts 4, 5, that increases further the surface area of the original straight shaft type umbrella.

Figure 8:
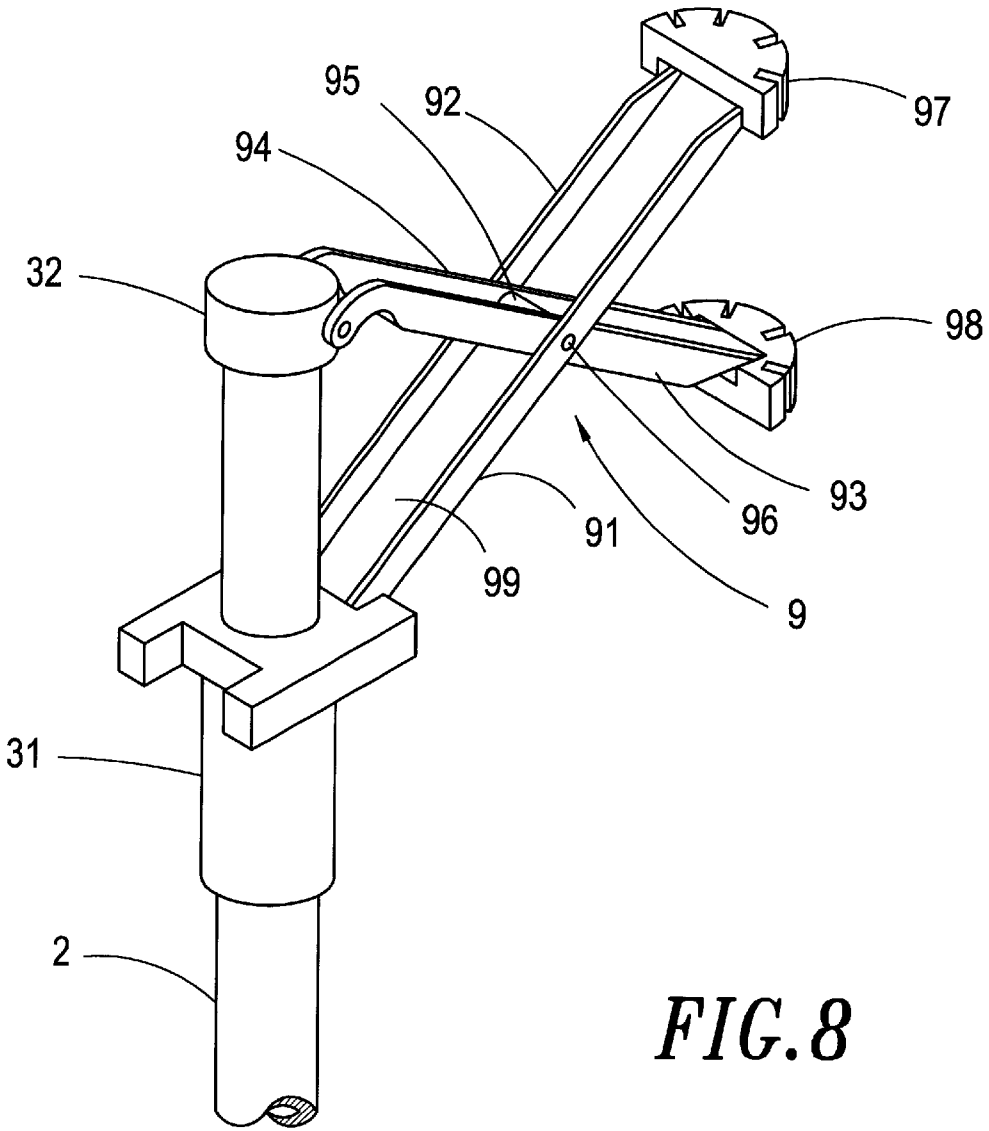
FIG. 8 is a schematic view showing the structural association of the umbrella with a novel structure according to the invention.

Referring to FIG. 8, a schematic view showing another embodiment of association of connecting parts in the novel umbrella structure according to the invention, said connecting part 9 can be constructed with four pieces 91, 92, 93, 94 by cross connecting two by two correspondingly, wherein ends of the first piece 93 and the second piece 94 are linked correspondingly with the main notch 32 and sub-runner 98, while the third piece 91 and the fourth piece 92 are provided by penetrating the space 99 formed between the first piece 93 and the second piece 94 and further linked correspondingly with the main runner 31 and the sub-notch 97 such that the third piece 91 and the first piece 93 can form a cross pivotal point. A cylinder 95 is provided between said two cross-pivotal points to prevent the sliding of the third piece 91 and the fourth piece 92. Finally, a pivotal pin 96 is provided by penetrating said two cross-pivotal points and said cylinder 95 to form said connecting part.

The novel umbrella structure according to the invention provides following advantages over conventional techniques:

1. According to the invention, connecting parts are provided on both sides of the shaft, said connecting parts are constructed mainly with two cross rib, where, since cross point thereof is positioned between the shaft and the surface frames, as it applies to a two-folding type of rib, the surface area can become twice of that of conventional folding umbrella. On the other hand, when it applies to a three- or more-folding type of rib, a larger surface area still can be retained such that in addition to the function of increasing surface area, the length of the closed umbrella can be reduced correspondingly.

2. According to the invention, connecting parts are connected directly with the main notch and main runner on the shaft in a manner that said connecting parts can move in association with sliding of the main notch up and down, that is contrary to the conventional umbrella which must utilize assisting stretcher to drive the connecting part. Accordingly, the novel structure of the invention is simpler than the conventional umbrella and time required for fabrication thereof is correspondingly reduced leading to the effect of lowering its production cost.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A collapsible umbrella frame structure comprising:

(a) a shaft having an intermediate portion extending longitudinally from a top end portion, said top end portion defining a main notch;

(b) a main runner slidably engaging said intermediate portion of said shaft, said main runner being displaceable relative to said intermediate portion between umbrella opening and closing positions;

(c) a pair of surface frames disposed on opposing lateral sides of said shaft, each said surface frame including a sub-notch and a branched rib extending therefrom, said surface frame including a sub-runner and a main rib extending therefrom, said branched rib being pivotally coupled to a free end of said main rib, said main rib having an auxiliary rib pivotally coupled to extend from an intermediate portion thereof, said sub-notch and said sub-runner being displaceably spaced one relative to the other;

(d) a pair of connecting parts each extending between said shaft and one of said surface frames, each said connecting part including first and second ribs pivotally joined in cross-linked manner, said first rib extending between said main notch and said sub-runner of said one surface frames, said second rib extending between said main runner and said sub-notch of said one surface frames;

whereby the space between said sub-runner and said sub-notch of each said surface frame is variable responsive to the displacement of said main runner between said umbrella opening and closing positions to alternatively expand and collapse the umbrella frame.

2. The collapsible umbrella frame structure as recited in claim 1 wherein each said surface frame includes a plurality of said branched and main ribs, each said branched rib being pivotally coupled to at least one said main rib.

3. The collapsible umbrella frame structure as recited in claim 1 wherein at least one of said first and second ribs of said connecting parts is formed by a pair of parallel elongate pieces pivotally connected to the other of said first and second ribs by a cylinder extending transversely therethrough.

4. The collapsible umbrella frame structure as recited in claim 3 wherein each of said first and second ribs of said connecting parts is formed by a pair of parallel elongate pieces pivotally connected to the other of said first and second ribs by a cylinder extending transversely therethrough.

5. The collapsible umbrella frame structure as recited in claim 1 further comprising a compressive spring coupled to said main runner and said shaft for resiliently biasing said main runner to one of said umbrella and closing positions.

6. The collapsible umbrella frame structure as recited in claim 5 wherein said umbrella frame is resiliently biased by said compressive spring to have a self-opening configuration.

7. The collapsible umbrella frame structure as recited in claim 1 wherein said shaft has a straight shaft configuration.

8. A collapsible umbrella frame structure comprising:

(a) a shaft having an intermediate portion extending longitudinally from a top end portion, said top end portion defining a main notch;

(b) a main runner slidably engaging said intermediate portion of said shaft, said main runner being displaceable relative to said intermediate portion between umbrella opening and closing positions;

(c) a pair of surface frames disposed on opposing lateral sides of said shaft, each said surface frame including a sub-notch and a branched rib extending therefrom, said surface frame including a sub-runner and a main rib extending therefrom, said branched rib being pivotally coupled to said main rib, said sub-notch and said sub-runner being displaceably spaced one relative to the other;

(d) a pair of connecting parts each extending between said shaft and one of said surface frames, each said connecting part including first and second ribs pivotally joined in cross-linked manner, said first rib extending between said main notch and said sub-runner of said one surface frame, said second rib extending between said main runner and said sub-notch of said one surface frame, at least one of said first and second ribs of each connecting part having formed through an intermediate portion thereof a port, said port receiving the other of said first and second ribs therethrough;

whereby the space between said sub-runner and said sub-notch of each surface frame is variable responsive to the displacement of said main runner between said umbrella opening and closing positions to alternatively expand and collapse the umbrella frame.

9. The collapsible umbrella frame structure as recited in claim 8 wherein each said connecting part includes a cylinder extending transversely through said port for pivotally connecting first and second ribs.

10. The collapsible umbrella frame structure as recited in claim 9 wherein said first and second ribs defines an elongate contour having a predetermined length dimension, said predetermined length dimensions of said first and second ribs being substantially equal.

* * * * *